United States Patent [19]

Ouchi

[11] 4,314,663

[45] Feb. 9, 1982

[54] SWINGING TYPE ROTORS OF CENTRIFUGAL MACHINES

[75] Inventor: Yoshiichi Ouchi, Tokyo, Japan

[73] Assignee: Kabushiki Kaisha Kubota Seisakusho, Tokyo, Japan

[21] Appl. No.: 189,179

[22] Filed: Sep. 22, 1980

[30] Foreign Application Priority Data

Dec. 31, 1979 [JP] Japan ..... 54-183045

[51] Int. Cl.[3] ..... B04B 9/12

[52] U.S. Cl. ..... 233/26

[58] Field of Search ..... 233/26, 27; 57/76

[56] References Cited

U.S. PATENT DOCUMENTS 3,722,791 3/1973 Wright ..... 233/26

4,009,824 3/1977 Wright ..... 233/26

*Primary Examiner*—Billy J. Wilhite

*Attorney, Agent, or Firm*—Charles E. Pfund

[57] ABSTRACT

In a swinging type rotor of a centrifugal machine of the type wherein the rotor is provided with a plurality of equally spaced radial arms and each arm is provided with a pair of trunnion pins for hanging buckets, a through opening extending in a direction perpendicular to a longitudinal axis of each arm is formed near an outer end thereof. A pair of hollow trunnion pins are inserted into opposite ends of the through openings. The hollow trunnion pins are provided with oppositely directed screw threads mating with a threaded pin. Outer portions of the trunnion pins are inclined toward the arm. Directions of the screw threads of the trunnion pins and of the threaded pin are selected such that when the buckets are swung about the trunnion pins under centrifugal force threading of the trunnion pins are tightened.

4 Claims, 4 Drawing Figures

SWINGING TYPE ROTORS OF CENTRIFUGAL MACHINES

BACKGROUND OF THE INVENTION

This invention relates to a centrifugal machine in which centrifugal force is applied to a sample for effecting separation or precipitation, more particularly, a so-called swinging type rotor wherein buckets containing the sample are hung on arms of the rotor and rotated thereby.

One example or a so called Beckman type centrifugal machine is disclosed in U.S. Pat. No. 4,009,824 issued to Herchel E. Wright on Mar. 1, 1977. The centrifugal machine disclosed therein comprises a plurality or radially extending arms which are equally spaced apart in the circumferential direction. Each arm is provided with a single opening near the outer end thereof parpendicularly to the longitudinal axis of the arm. A trunnion pin is inserted through the opening and has accurately oriented opposite extremities acting as trunnions. Buckets are swingably hung on opposing extremities or adjacent arms. With this construction, the diameter of the openings through which the trunnion pins extend become large, thus increasing the thickness of the arms. To obviate this difficulty, it is necessary to make thin the trunnion pins. When the diameter of the trunnion pins is reduced, it is necessary to make them with a material having a high mechanical strength. This, however, reduces, the bearing areas of the buckets so that it is necessary to make also the buckets with a strong material. These limitations increase the cost of manufacturing.

Another prior art swinging type rotor is shown in FIGS. 1 and 2 of the accompanying drawing. A rotor 11 shown therein has an opening 13 at the central portion thereof 12 to receive a rotating shaft of a driving motor not shown. A plurality of integral arms 14 equal spaced apart in the circumferential direction extend in the radial direction. At the outer end of each arm are inserted trunnion pins, the axes thereof intersecting at an angle buckets 16 are hung on opposing trunnion pins 15 of adjacent arms 14. More particularly, each bucket in guided by a pair of parallel recesses 17 formed on both sides of the bucket so that the upper ends of the recesses engage the ends of the trunnion pins to hang the buckets to be swingable about the axes of the opposing trunnion pins. Although in FIGS. 1 and 2 only one bucket is shown it will be clear that six buckets are hung in the construction shown. As the rotor 11 is rotated, the buckets are swung from the dotted line position to the solid line position shown in FIG. 2.

In the swinging type rotor, because the spacings between adjacent arms are narrow, it has been impossible or difficult to form openings for receiving the trunnion pins by inserting a tool into the narrow gaps between adjacent arms. For this reason, according to a prior art method of manufacturing openings is for receiving the trunnion pins 15 were formed through opposite side surfaces of the outer end of each arm. The axes of the openings make acute angles with respect to the center line of each arm and the axes of the trunnion pins received in a pair of openings 18 of each arm cross each other with an angle. Accordingly, the thickness of the portions is on the outsides of the openings 18 as viewed from the center off the rotor 11 is small, so that these thin portions would be ruptured or deformed under a strong centrifugal force. Rupture of the portions 19 result in fly off of the buckets thus causing a serious damage especially when the rotor is rotated at an extremely high spaced.

SUMMARY OF THE INVENTION

Accordingly, it is an object of this invention to provide an improved swinging type rotor capable of operating at a sufficiently high speed so as to inpart strong centrifugal force to the sample contained in the buckets.

Another object of this invention is to provide an improved swinging type rotor having a light weight and a small thickness thus saving the material.

According to this invention there is provided a swinging type rotor of a centrifugal machine comprising a plurality of radial arms equally spaced apart in the circumferential direction, each arm being provided with a through opening near an outer end thereof, the through opening extending at right angles with respect to a longitudinal axis of the arm and to an axis of rotation of the rotor, a pair of trunnion pins inserted into opposite ends the trough opening, the trunnion pins having cylindrical portions inclining toward the longitudinal axis of the arm and adapted to hung buckets and flanges eccentric with respect to the through opening, portions of the trunnion pins inserted into the through opening having cylindrical openings provided with oppositely directed screw theads; a threaded pin mating with the screw threads of the trunnion pins; at least one of the trunnion pins being provided with a tool inserting tool reaching one end of the threaded pin for inserting a tool for rotating the same; and directions of the screw threads of the trunnion pins and those of the threaded pin being selected such that when the buckets are swung about the trunnion pins under centrifugal force threadings of the trunnion pins are tightened.

DESCRIPTION OF THE PREFERRED EMBODIMENTS

Figure 1:
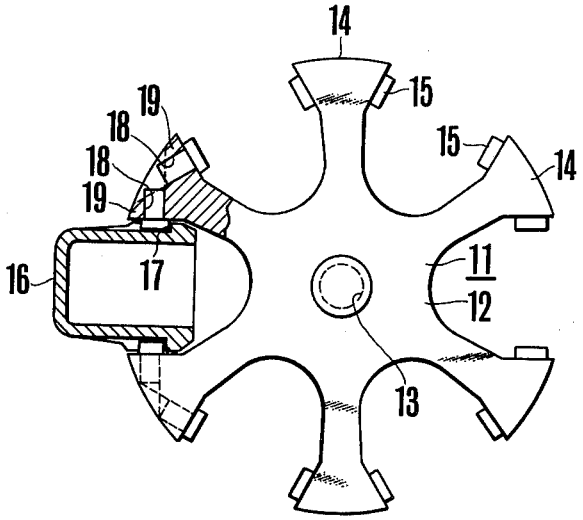
FIG. 1 PRIOR ART
FIG. 1 is a plan view showing a prior art swinging type rotor of a centrifugal machine.
Figure 2:
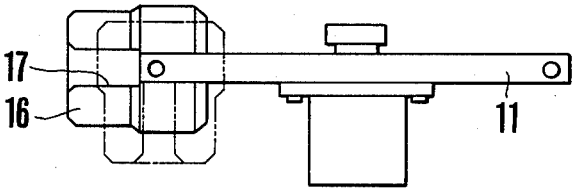
FIG. 2 PRIOR ART
FIG. 2 is a plan view of the rotor shown in FIG. 1.
Figure 3:
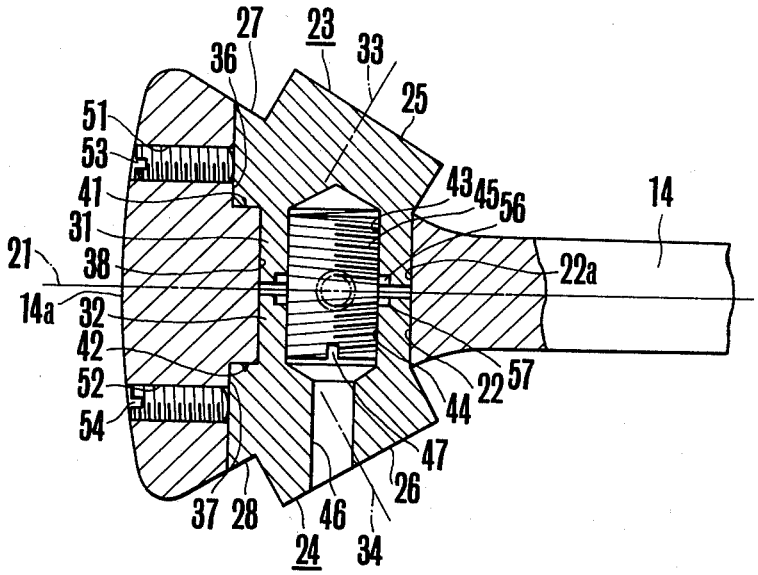
FIG. 3 is an enlarged sectional view of the outer end of one arm of the rotor.
Figure 4:
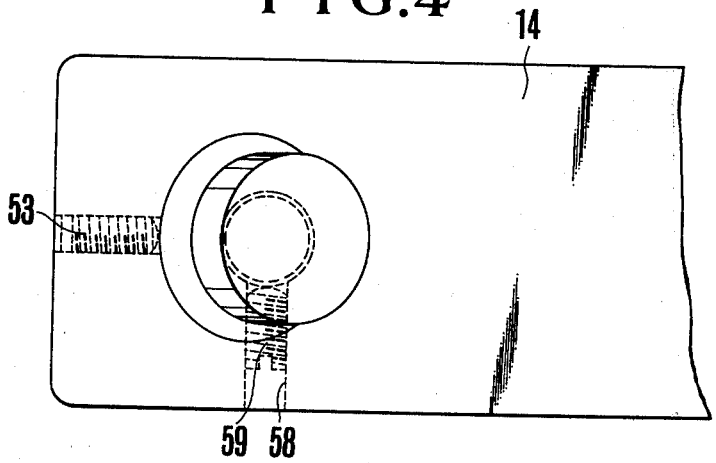
FIG. 4 is a side view of the portion shown in FIG. 3.

One embodiment of the swinging type rotor embodying the invention will now be described with reference to FIGS. 3 and 4. A through opening 22 is formed near the outer end of a rotor arm 14 in a direction perpendicular to the longitudinal axis 21 of the arm and to the axis of rotation of the rotor, and a pair of trunnion pins 23 and 24 are inserted into the opposite ends of the through opening 22. These trunnion pins 23 and 24 extend outwardly from both sides of the arm 14 and respectively comprise cylindrical portions 25 and 26 for hanging buckets, flanges 27 and 28 at intermediate portions of the pins and engaging the opposite ends of the through opening 22, and inner portions 31 and 32 inserted into the through opening. These portions of each trunnion pins are formed integrally.

The axes of the cylindrical portions 25 and 26 coincide with the axes 33 and 34 of the swinging of the buckets caused by centrifugal force, which the axes of the inner portions 31 and 32 coincide with the axis of the through opening 22. In other words, the cylindrical portions 25 and 26 are bent toward the axis of rotation with respect to the axis of the through opening 22. Flanges 27 and 28 are shaped such that their diameters increase toward the outer end of the arm. In other words, the flanges are shaped eccentrically with respect to the cylindrical portions 25 and 26. Consequently, the opposite ends of the through opening 22 are enlarged such that their enlarged diameter portions 36 and 37 on the sides opposite to the axis of rotation of the rotor would be positioned on the outer sides of the intermediate portion of the through opening 22. Between these enlarged diameter portions 36 and 37 and the small diameter portions 38 of the trunnion pins 25 and 26 are formed abutting surfaces 41 and 42 on the inner surfaces of the flanges 27 and 28.

Oppositely threaded openings 43 and 44 are formed on the inner surfaces of the trunnion pins 23 and 24 respectively for receiving opposite ends of a threaded pin 45. At least one of the trunnion pins, for example pin 24, is formed with a tool inserting opening 46 extending from the outer end of the pin 24 to the threaded opening 44. The tool inserting opening 46 and the threaded opening are coaxial. A driver receiving groove 47 is formed at one end of the threaded pin 45 so as to rotate the same with a screw driver, for example.

When the rotor is rotated at a high speed, a large centrifugal force is applied to the buckets hung on the trunnion pins 23 and 24 to swing outwardly the buckets. At this time a torque is applied to the trunnion pins 23 and 24 due to friction. The direction of screw threads are determined such that the trunnion pins are tightened by the torque or rotated in a direction to more deeply fitting into the through opening 22. Thus, the screw threads in the threaded openings are righthanded so that as the torque is applied to the trunnion pin 24 to rotate the same in the clockwise direction, the pin 24 tends to enter into the through opening 22. In contrast, the trunnion 23 is cut with lefthand screw threads. Then the trunnion pins 23 and 24 are sufficiently tightened, and the inner surfaces of the flanges 27 and 28 engage the abutting surfaces 41 and 42 so that the pins 23 and 24 would not enter further. Under these conditions, the inner ends of the inner portions 31 and 32 do not contact with each other but spaced with a small gap.

To assemble the component parts described above, at first the threaded pin 45 is positioned at the center of the through opening 22 and the trunnion pins 23 and 24 are inserted into the through opening 22 from the opposite sides thereof. After coinciding the axes of the cylindrical portions 25 and 26 with the axes of rotation 33 and 34 of the buckets, that is after bringing the trunnion pins to predetermined attitudes, threaded openings 43 and 45 are engaged with the threads of the threaded pin 45 by at least one pitch. While maintaining this attitude, a screw driver, not shown, is inserted into the tool inserting opening 46 to engage the groove 47. Then the threaded pin 45 is rotated in a direction to tighten the screw threads thereby pulling the trunnion pins 23 and 24 toward each other. At this time, the trunnion pins 23 and 24 are tightly held to maintain them in the predetermined attitudes. Thus, the threaded pin 45 is strongly rotated until the bottom surfaces of the flanges 27 and 28 are firmly abutted against the abutting surfaces 41 and 42.

Since the directions of screw threads 43 and 44 are selected as above described, as the buckets tend to swing under a strong centrifugal force, the trunnion pins would be tightened instead of loosened. If desired, for the purpose of preventing the trunnion pins from rotating small openings 51 and 52 may be formed on the side opposite to the axis of rotation to receive set screws 53 and 54.

Since the through opening 22 is formed in a direction perpendicular to the longitudinal axis 21 of the arm 14 it is possible to readily machine the through opening 22 without being interfered with adjacent arms. Even when the through opening 22 is formed, a sufficiently thick portion 14*a* is left on the outer end of the arm thus preventing damage by the strong centrifugal force. Even when the diameter of the through opening 22 is reduced it is possible to receive the strong centrifugal force by widened flanges 27 and 28. In other words even when the thickness of the rotor is reduced it is possible to make small the through opening thus permitting a design assuring a suitable thickness at the portion of forming the through opening. This means that it is possible to manufacture a light weight rotor with smaller quantity of the raw material.

As the trunnion pins project obliquely from the rotor arm, when a strong centrifugal force is applied, forces tending to draw out the trunnion pins wuld be applied thereto. However, such forces are balanced with each other through the threaded pin thus preventing the draw out of the trunnion pins.

Although it is difficult to accurately cut the screw threads so that oppositely directed screw threads of the threaded openings 43, 44 and the threaded pin 45 smoothly mate with each other, this difficulty can be avoided by increasing the diameters of the inner threaded portions of the trunnion pins as at 56 and 57. Conversely, a groove not formed with screw threads may be provided at the center of the threaded pin 45. After the trunnion pins 23 and 24 have been coupled together by rotating the threaded pin 45, the tool inserting opening 46 may be closed by a filler. Furthermore, in order to prevent the threaded pin 45 from rotating due to vibration, a small opening 58 may be formed, as shown in FIG. 4, on the rotor arm to the outer-surface of the threaded pin 45 to receive set screw 59.

What is claimed is:

1. A swinging type rotor of a centrifugal machine comprising a plurality of radial arms equally spaced apart in the circumferential direction, each arm being provided with a through opening near an outer end thereof, said through opening extending at right angles with respect to a longitudinal axis of said arm and to an axis of rotation of said rotor; a pair of trunnion pins inserted into opposite ends of said through opening, said trunnion pins having cylindrical portions inclining towards said longitudinal axis of said arm and adapted to hang buckets and having flanges eccentric with respect to said through opening, portions of said trunion pins inserted into said through openings having cylindrical openings provided with oppositely directed screw threads; a threaded pin mating with the screw threads of said trunnion pins; at least one of said trunnion pins being provided with a tool inserting opening reaching one end of said threaded pin for inserting a tool for rotating the same; and the directions of said screw threads of said trunnion pins and those of said threaded pin being selected such that when the buckets are swung above said trunnion pins under centrifugal force threadings of said trunnion pins are tightened.

2. The swingable rotor according to claim 1 wherein said flanges engage portions of side surfaces of each arm.

3. The swingable rotor according to claim 1 wherein one end of said threaded pin is provided with a groove to be engaged by a screw driver inserted through said tool inserting opening.

4. The swingable rotor according to claim 1 which further comprises set screws provided at said outer ends for preventing rotation of said trunnion pins.

* * * * *